US006629016B1

(12) United States Patent
Smith

(10) Patent No.: US 6,629,016 B1
(45) Date of Patent: Sep. 30, 2003

(54) APPARATUS AND METHOD OF MANUFACTURING EXPANDED SHEET METAL

(75) Inventor: Jeffrey E. Smith, Alpharetta, GA (US)

(73) Assignee: Amerimax Diversified Products, Inc., Norcross, GA (US)

( * ) Notice: Subject to any disclaimer, the term of this patent is extended or adjusted under 35 U.S.C. 154(b) by 41 days.

(21) Appl. No.: 10/109,077

(22) Filed: Mar. 28, 2002

(51) Int. Cl.[7] ..... G06F 19/00; B21D 31/04
(52) U.S. Cl. ..... 700/145; 700/90; 29/6.1
(58) Field of Search ..... 700/90, 117, 145, 700/159; 29/6.1, 896.6, 709

(56) References Cited

U.S. PATENT DOCUMENTS 4,594,280 A * 6/1986 Coyon et al. ..... 428/135
4,712,868 A * 12/1987 Tung et al. ..... 359/514
4,921,118 A * 5/1990 Gass ..... 220/88.1
5,239,735 A * 8/1993 Tanaka et al. ..... 29/6.1
5,302,466 A * 4/1994 Davis et al. ..... 428/573
5,365,819 A * 11/1994 Maida et al. ..... 83/332
5,461,761 A * 10/1995 Knopfli et al. ..... 29/6.1

OTHER PUBLICATIONS

Metalex; Process: Retrieved from the Internet on Feb. 25, 2002 at http://www.meltx.com/process.html.
Metalex; Terminology: pp. 1–2; Retrieved from the Internet on Feb. 25, 2002 at http://www.metlx.com/terminology.html.
Metalex; Micromesh: Retrieved from the Internet on Feb. 25, 2002 at http://www.metlx.com/micromesh.html.

* cited by examiner

*Primary Examiner*—Jayprakash N. Gandhi
(74) *Attorney, Agent, or Firm*—Morris, Manning & Martin, LLP

(57) ABSTRACT

An apparatus and method for creating expanded and non-expanded regions on a sheet of sheet metal. The apparatus includes a programmable controller, a sheet metal feeder for incrementally advancing the sheet metal, and a cutter/expander for generating rows of expanded metal apertures. The controller selectively controls both the amount of incremental advance provided to the sheet metal by the feeder and the timing and location of the cutting and expanding provided by the cutter/expander; the combination of which creates such regions.

19 Claims, 3 Drawing Sheets

APPARATUS AND METHOD OF MANUFACTURING EXPANDED SHEET METAL

FIELD OF THE PRESENT INVENTION

The present invention relates to an apparatus and method for processing metal and, more particularly, to an apparatus and method of manufacturing sheet metal having regions of expanded metal and regions of non-expanded metal.

BACKGROUND OF THE PRESENT INVENTION

Expanded sheet metal is available in a wide range of patterns and gauges and can be made from several readily available metals or metal alloys with little or no metal loss during manufacturing. Expanded sheet metal is used in a wide variety of applications, including for use as filters, screens, grates, fencing, gutter protectors, battery plates, and other industrial or commercial applications.

One of the benefits of expanded sheet metal is that it is stronger per pound and lighter per foot than non-expanded sheet metal. Another benefit is the fact that expanded sheet metal is gas or fluid permeable.

Conventionally, the process of creating expanded sheet metal is accomplished by creating slits or cuts in a piece of solid sheet metal and then expanding or stretching the metal to create the plurality of openings or apertures therein. The process of expanding or stretching the sheet metal may be performed by stretching the metal in the direction of feed, opposite to the direction of feed, or lateral to the direction of feed. Such expanding of the sheet metal may be accomplished by inserting an object, such as a die, into the previously cut apertures and/or by stretching or pulling the metal from an edge or end of the sheet.

For some applications, it would be desirable to have regions or strips of non-expanded sheet metal included between regions of expanded sheet metal. The reasons for having such regions or strips of non-expanded metal are many. For example, it is often necessary to weld two different pieces of expanded sheet metal together to create longer pieces or to create three-dimensional shapes, such as cylindrical filters. For such applications, it is much easier and creates a stronger bond to weld two non-expanded metal regions together rather than to attempt to weld a region of expanded sheet metal to a non-expanded region or to another region of expanded sheet metal.

Typically, the inclusion of regions or strips of non-expanded sheet metal on a larger piece of sheet metal being expanded are restricted to the fixed arrangement of slit cutters along the processing path or, if the slit cutters are mounted to a roller, along the roller surface. Thus, the size, shape, spacing, and frequency of occurrence of regions of non-expanded sheet metal on a larger piece of sheet metal that is being expanded are generally fixed by virtue of discrete spaces between the cutting implements along the processing path or around the roller. Further, there is no capability to vary size, shape, spacing or frequency of the regions of non-expanded sheet on a particular piece of sheet metal being processed.

As can be appreciated, there is a continuing need for an improved metal expanding apparatus and methodology for manufacturing expanded sheet metal having regions of non-expanded sheet metal therein for use in a wide variety of applications.

There is also a continuing need for such an improved metal expanding apparatus and methodology for controlling the length of the expanded metal regions and/or the frequency of the non-expanded metal regions on a sheet of sheet metal.

There is a further continuing need for such an improved metal expanding apparatus and methodology, which is capable of creating regions of non-expanded sheet metal interspersed with regions of expanded sheet metal which are not defined solely by the discreet spaces or pre-positioning of each cutting implement.

The present invention meets one or more of the above-referenced needs, and potentially other needs not set forth above, as will be described herein in greater detail.

SUMMARY OF THE PRESENT INVENTION

The present invention relates generally to an apparatus and method for processing metal and, more particularly, to an apparatus and method of manufacturing sheet metal having regions of expanded metal and regions of non-expanded metal In particular, a first aspect of the invention is directed toward an apparatus for creating expanded and non-expanded regions on a sheet of sheet metal that includes a programmable controller, a feeder adapted to receive the sheet and responsive to the controller for incrementally advancing the sheet along a processing path, a cutter/expander positioned along the processing path and adapted to receive the sheet from the feeder, the cutter/expander responsive to the controller for generating a row of expanded metal apertures between each incremental advance of the sheet, the apertures in alternating rows being laterally offset from each other, each incremental advance of the sheet by the feeder having a first length when creating a respective expanded region of the sheet and a second length greater than the first length when creating a respective non-expanded region of the sheet.

In a feature of the apparatus, the controller is a computer having computer-readable instructions installed therein.

Preferably, the feeder comprises a pair of rollers and a feed motor for driving the rollers. Such feed motor is preferably a servo motor. Further, the rollers advance the sheet by means of pressure applied to the sheet or by means of frictional force applied to the sheet.

In an embodiment, the cutter/expander comprises an upper and a lower die and the sheet advances between the two die. Preferably, the die are offset from each other in the direction of the processing path. In an aspect of the invention, the upper die comprises a mounting arm and a plurality of pattern cutters. Preferably, the upper die is selectively movable perpendicular to the plane of the sheet between a disengaged and an engaged position, each respective row of apertures being generated by the pattern cutters when the upper die moves from the disengaged position to the engaged position.

In yet a further feature, the upper die is selectively moveable parallel to the plane of the sheet between a first cutting position and a second cutting position laterally offset from the first cutting position. Additionally, the cutter/expander further comprises a cam assembly and a cam motor for driving the cam assembly, the cam assembly controlling movement of the upper die between the first and second cutting positions, the upper die being in the first position when creating a first row of apertures and in the second position when creating a second row of apertures adjacent to the first row whereby the apertures in adjacent rows are laterally offset from each other.

In a preferred embodiment, the resulting expanded metal region has a mesh pattern in appearance.

In yet another aspect of the invention, a method for creating expanded and non-expanded regions on a sheet of sheet metal includes the steps of advancing the sheet a first predetermined distance along a processing path to define a first respective non-expanded metal region, creating a respective expanded metal region which includes the sub-steps of generating a first row of expanded metal apertures across the sheet, advancing the sheet a second predetermined distance along the processing path, and generating a second row of expanded metal apertures across the sheet, the first and second row of apertures being laterally offset from each other, and then the step of advancing the sheet a third predetermined distance along the processing path to define a second respective non-expanded metal region.

In a preferred embodiment, the second predetermined distance is shorter than the first and third predetermined distances. In one preferred embodiment, the first predetermined distance is the same as the third predetermined distance. In another preferred embodiment, the first predetermined distance is different from the third predetermined distance.

In yet another preferred embodiment, the steps of generating the rows of expanded metal apertures includes simultaneously slitting and stretching selected locations across the sheet.

In yet a further embodiment, the step of creating the respective expanded metal region further includes, after the step of generating the second row of expanded metal apertures, again advancing the sheet the second predetermined distance along the processing path and repeating a plurality of times the steps of generating the first row of expanded metal apertures, advancing the sheet the second predetermined distance, generating the second row of expanded metal apertures, and again advancing the sheet the second predetermined distance.

The above and other objects and features of the present invention are disclosed and/or will become apparent from the following description of preferred embodiments of the present invention, which includes the drawings, the detailed description given herein, and the appended claims.

BRIEF DESCRIPTION OF THE DRAWINGS

Further features and benefits of the present invention will be apparent from a detailed description of preferred embodiments thereof taken in conjunction with the following drawings, wherein similar elements are referred to with similar reference numbers, and wherein.

DETAILED DESCRIPTION OF PREFERRED EMBODIMENTS

Figure 1:
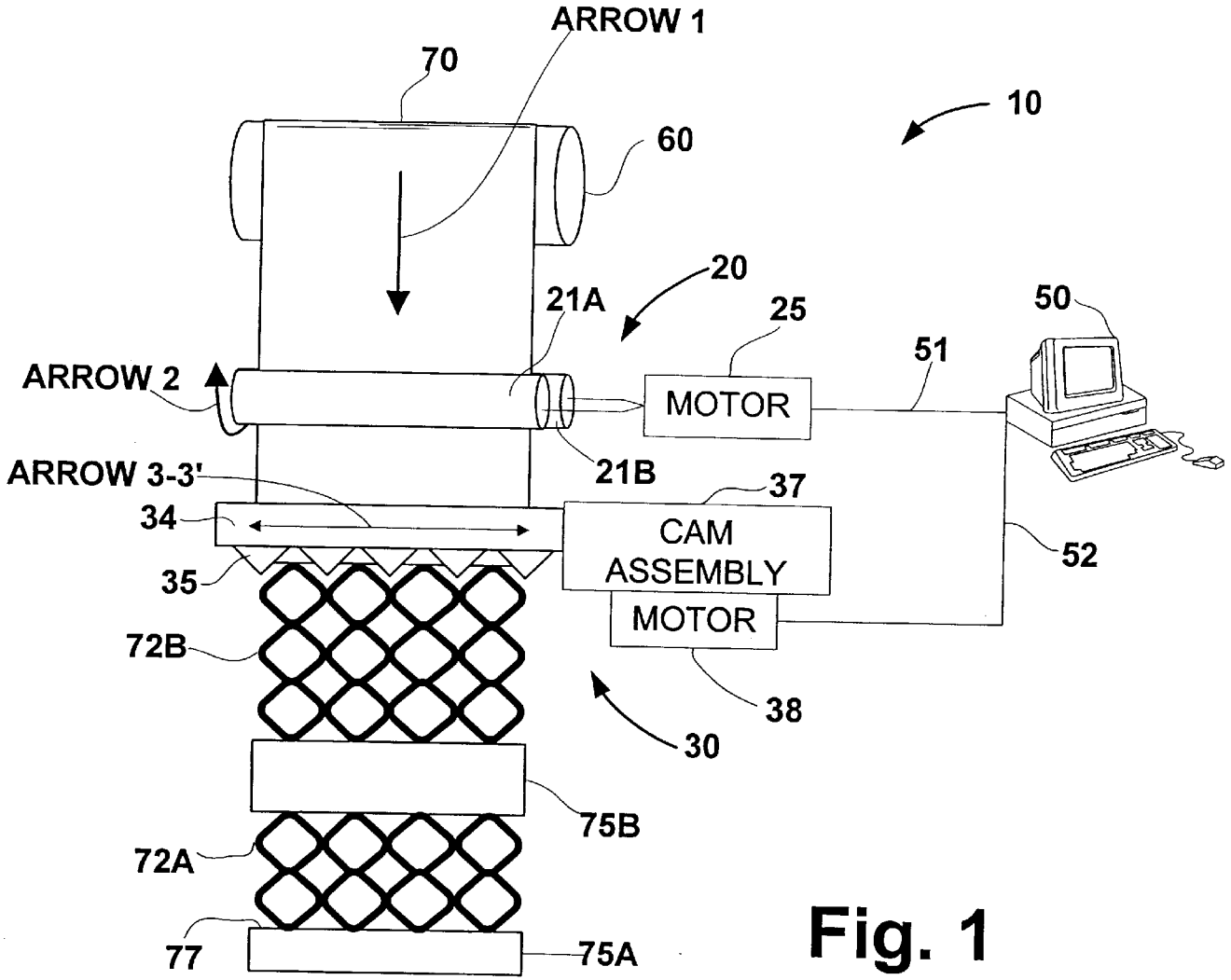
FIG. 1 illustrates a top view of an embodiment of the sheet metal expanding apparatus according to the present invention.
Figure 2:
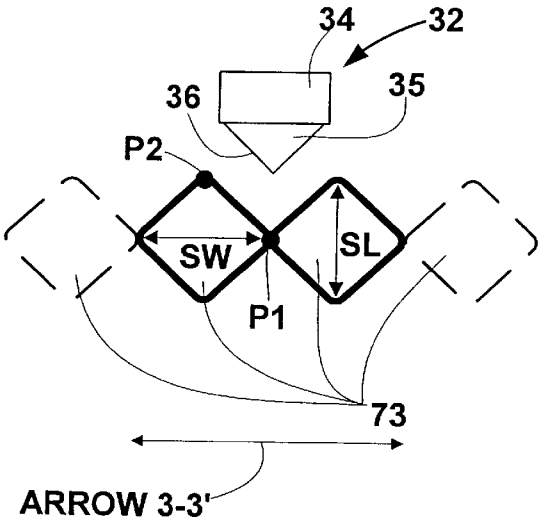
FIG. 2 illustrates the relational arrangement of the die of the cutter/expander of the apparatus of FIG. 1 with respect to the design pattern.
Figure 3:
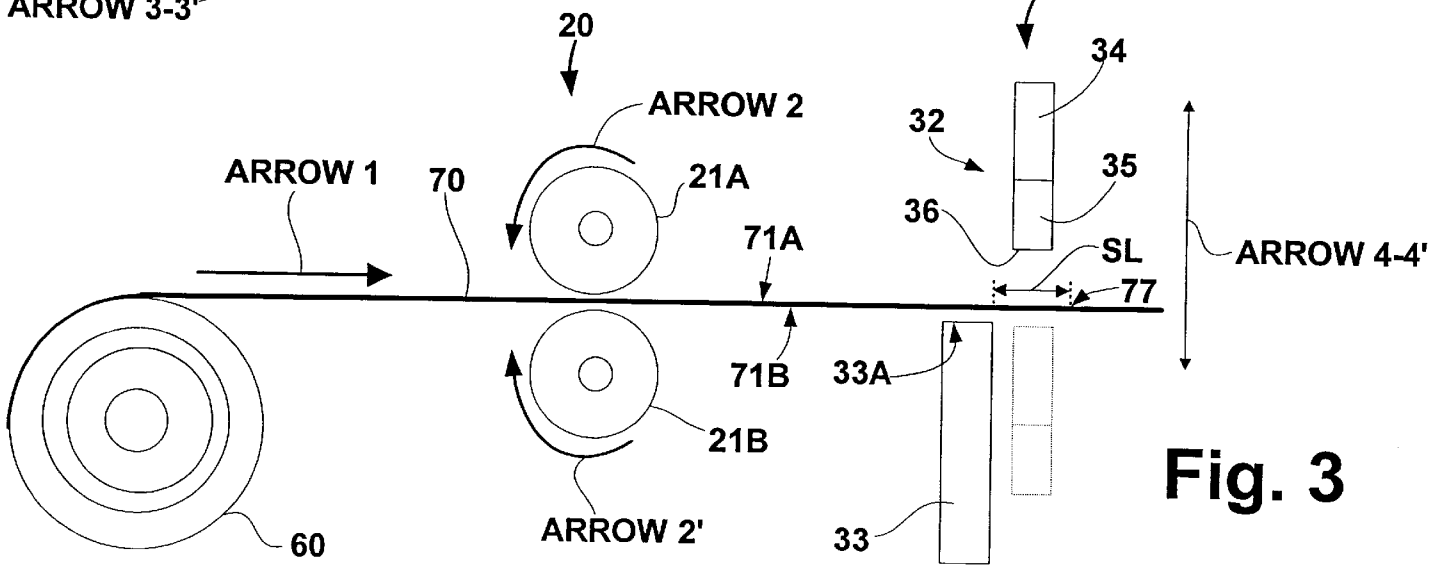
FIG. 3 illustrates a side view of the sheet metal expanding apparatus of FIG. 1.

Referring now to the drawings and, more specifically, first to FIGS. 1 through 3, a sheet metal expanding apparatus 10 of the present invention is illustrated. The sheet metal expanding apparatus 10 includes, among other components, a sheet metal feeder 20 and a cutter/expander 30. The sheet metal expanding apparatus 10 is specifically adapted to receive a single layer of sheet metal 70, which is wound about a roll 60. The sheet metal 70 has both an upper and a lower planar surface, 71A,71B, respectively. Suitable types of sheet metal for use with the present invention include, but are not limited to, stainless steel, galvanized steel, carbon, aluminum, titanium, and various other conventional metal alloys.

The sheet metal feeder 20 includes rollers 21A,21B, which are designed to rotate in the direction of ARROWS 2 and 2', respectively. The sheet metal feeder 20 also includes a feed motor 25, which is preferably a servo motor—although any conventional motor suitable for performing the functions described herein is acceptable, as will be appreciated by one skilled in the art. The motor 25 is controlled by controller 50, which is preferably a conventional computer or similar machine controller having a microprocessor installed therein and capable of being programmed with suitable software or other machine instructions. Controller 50 interacts with the motor 25 via communication line 51, which, although shown as a solid line, represents either a hard-wired or wireless communication link between the controller 50 and motor 25, in conventional manner.

The cutter/expander 30 includes an upper and a lower die 32,33, respectively. The upper die 32 includes a mounting arm 34 and one or more discrete pattern cutters 35 mounted thereto. The discrete pattern cutters 35 have pattern design edges 36. As shown in this exemplary embodiment, the pattern design edges 36 have a substantially half-a-diamond (or triangular) shaped contour; however, any other geometrical designs, such as half-a-circle, may be substituted for the half-a-diamond shape contour depending upon the desired pattern, size, and shape of the apertures or openings to be created in the expanded region of the sheet metal, as will become apparent hereinafter. The lower die 33 merely provides a flat surface to counter the cutting and expanding forces exerted by the upper die 32 when it engages the sheet metal 70 during the cutting and expanding process described in greater detail herein.

The cutter/expander 30 also includes a cam assembly 37 that mechanically engages the mounting arm 34. Movement of the cam assembly 37 and, correspondingly, movement of the mounting arm 34, are controlled by cam motor 38. Like motor 25, cam motor 38 is preferably a servo motor—although any conventional motor suitable for performing the functions described herein is acceptable, as will be appreciated by one skilled in the art. In addition, motor 38 is controlled by controller 50 via communication line 52, which, although it is shown as a solid line, represents either a hard-wired or wireless communication link between the controller 50 and motor 38, in conventional manner. In an alternative embodiment, motors 25 and 38 are controlled by separate controllers (not shown) rather than both being controlled by the same controller 50. Movement of the cam assembly 37 enables the upper die 32 to move in a side-to-side (or lateral) direction, as illustrated by ARROWS 3 and 3', relative to the direction of feed of the sheet metal along the processing path, which is illustrated by ARROW 1. The cam assembly 37 also enables the upper die 32 to move in an up-and-down direction, as illustrated by ARROWS 4 and 3', perpendicular to the surfaces 71A,71B of the sheet metal 70.

In operation, the layer of sheet metal 70 is wound off of roll 60 and fed by sheet metal feeder 20 into the cutter/ expander 30. More specifically, the sheet metal 70 is threaded between rollers 21A,21B, which are adapted to engage the sheet metal 70 for the purpose of feeding the sheet metal 70 in the direction of ARROW 1 between die 32,33. As shown in FIG. 3, the lower surface 71B of sheet metal 70 passes over the top surface 33A of the lower die 33 and below the discrete pattern cutters 35 of upper die 32. Rollers 21A,21B are synchronized so that an equal amount of feed force (frictional and/or pressure) is applied to both surfaces 71A,71B of the sheet metal 70. Thus, in one preferred embodiment, if the rollers 21A,21B are caused to rotate in discrete intervals (as opposed to continuously), the amount of such rotation for each discrete interval determines the corresponding distance that the sheet metal 70 advances along the processing path, designated by ARROW 1, for that discrete interval. In a second preferred embodiment, the rollers 21A,21B are caused to rotate continually but at varying rates of speed such that the sheet metal 70 advances along the processing path, designated by ARROW 1, at varying linear rates of speed.

Figure 4B:
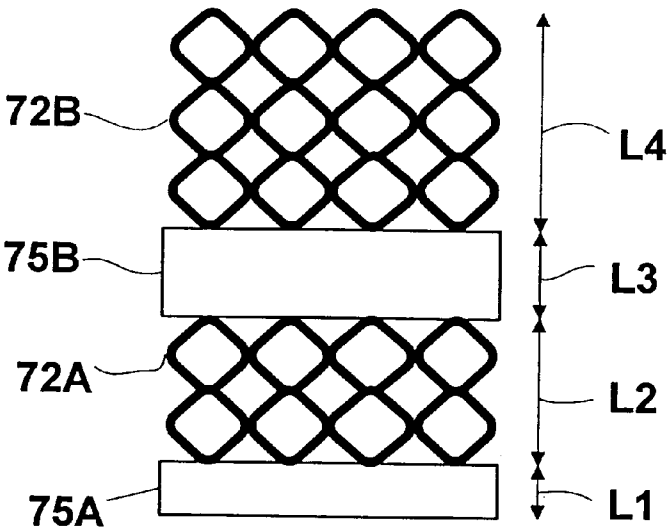
FIG. 4B illustrates a piece of sheet metal that has been processed by the apparatus of FIG. 1 and which depicts both regions of expanded and non-expanded sheet metal.
Figure 4A:
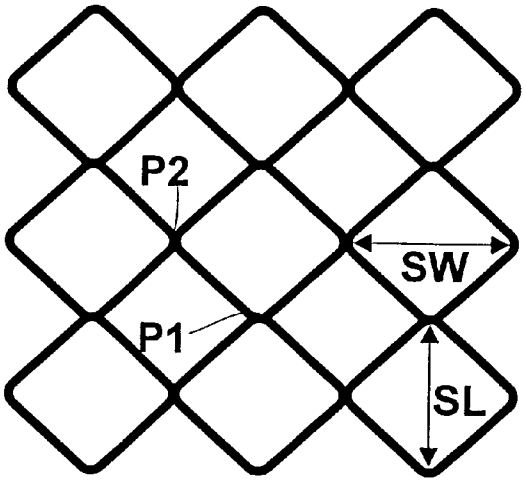
FIG. 4A illustrates an exemplary expanded metal design.

As shown in FIGS. 1, 4A, and 4B, the purpose of feeding the sheet metal 70 through the cutter/expander 30 is to create regions of expanded sheet metal 72A,72B interspersed with or alternating with regions of non-expanded sheet metal 75A,75B. The actual linear distance or length of each region of expanded and non-expanded sheet metal L1,L2,L3,L4 is arbitrary and is established according to the requirements for the application with which the processed sheet metal will be used. In the example shown in these FIGS. 1 and 4B, the lengths of each region L1,L2,L3,L4 are all different; however, one or more of these regions could be the same length, as desired. The process by which the apparatus 10 creates such regions and their corresponding lengths, which is controlled by suitable programming of the controller 50, is discussed in greater detail hereinafter.

In the first preferred embodiment, operation of the sheet metal feeder 20 and the cutter/expander 30 is coordinated by means of suitable programming of the controller 50 so that the sheet metal feeder 20 incrementally advances the sheet metal 70 a predetermined distance between each step of cutting and expanding performed by the cutter/expander 30. More specifically, each time the sheet metal feeder 20 stops advancing the sheet metal 70 (i.e., reaches the end of a discrete advance distance), the cutter/expander 30 cuts and expands a portion of the sheet metal 70. Correspondingly, after each step of cutting and expanding is performed, the sheet metal feeder 20 incrementally advances the sheet metal 70 a next, pre-determined distance. The actual length of such next, pre-determined distance varies depending upon whether the apparatus 10 is in the process of creating an expanded metal region 72 (which tends to require a relatively short advance of the sheet metal 70) or creating (actually preserving) a non-expanded metal region 75 (which tends to require a relatively longer advance of the sheet metal 70). The actual distance of the advance during the process of creating the expanded metal region 75 will depend upon the size and shape of the discrete pattern cutters 35. In addition, the number of times the sheet metal 70 is advanced this particular distance will depend upon the desired lengths L2,L4 of the respective expanded metal regions 72A,72B. Further, the actual distance of advance during the process of creating (or preserving) the particular non-expanded metal regions 75A,75B will likewise depend upon the desired lengths L1,L3 of the respective non-expanded metal regions 75A,75B.

With particular emphasis now on FIGS. 2 and 3, the process of creating a plurality of rows of expanded metal apertures across the sheet metal 70 to define a respective expanded metal region 72A,72B will now be described in greater detail. First, as stated previously, the sheet metal 70 advances forward between the lower and upper dies 32,33 the desired length L1 of the first non-expanded metal region, which in the first instance is region 75A. Preferably, the back edge 77 of the non-expanded region 75A will be approximately one strand length SL beyond the lower die 33, as best seen in FIG. 3. The upper die 32 then descends from a disengaged position above the top surface 71A of the sheet metal 70 to an engaged position through the plane of the sheet metal 70 at point P1, as best seen in FIG. 2. The process of descending from the disengaged position to the engaged position simultaneously cuts and expands the sheet metal 70 to form one-half of the diamond design 73. Thereafter, the upper die 32 is lifted back to the disengaged position above the plane of sheet metal 70 under the momentum of the cam assembly 37, as best seen in FIG. 3. Thereafter, the upper die 32 is shifted to the side (laterally) from a first cutting position to a second cutting position, in the direction of ARROW 3'. The distance from the first cutting position to the second cutting position is approximately one-half strand width SW, which places the upper die 32 above the sheet metal at point P2. Substantially simultaneously, the sheet metal 70 is incrementally advanced forward along the processing path by the feeder 20 a half a strand length SL.

Next, as the upper die 32 descends, in the direction of ARROW 4, under the momentum of the cam assembly 37 (again, from the disengaged position to the engaged position), the pattern design edges 36 of the discrete pattern cutters 35, form another row of half diamonds 73 in the sheet metal 70 to complete the generally diamond-shape design, as best seen in FIG. 2. The upper die 32 ascends, in the direction of ARROW 3', under the momentum of cam assembly 37 above the plane of sheet metal 70 and is shifted, in the direction of ARROW 3, back from the second cutting position to its original starting position (first cutting position) aligned with the position designated as point P1. The cycle continues until the desired length L2 of the expanded metal region 72A is created. At which point, the feeder 20 incrementally advances the sheet metal 70 again a desired distance L3 to form the next region of non-expanded sheet metal 75B.

In the second preferred embodiment, operation of the sheet metal feeder 20 and the cutter/expander 30 is calibrated or synchronized by means of suitable programming of the controller 50 so that the sheet metal feeder 20 moves continuously (although not necessarily at a constant rate of speed). In this embodiment, the cutter/expander 30 may either move continuously at a constant rate of speed or may move intermittently, as desired. For example, if the cutter/expander 30 moves at a constant rate of speed, varying the rate of speed of the sheet metal feeder 20 enables the apparatus to create the interspersed regions of expander and non-expanded metal. Thus, to create a region of non-expanded metal 75A,75B, the rollers 21A,21B rotate at a rapid rate of speed to cause a length L1 of the sheet metal to pass through the cutter/expander 30 while the upper die 32 is above the plane of the sheet metal 70. On the other hand, to create the region of expanded sheet metal 72A,72B, the rollers 21A,21B rotate at a much slower rate of speed so that the cutter/expander 30 is able to engage, cut, and expand the sheet metal 70 in a series of rows, as described above.

In the preferred embodiments, the diamonds or other geometrical shapes range from ⅛ to 2 inches wide in the direction SW and ¼ to 6-inches long in the direction SL.

In view of the foregoing detailed description of preferred embodiments of the present invention, it readily will be understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Furthermore, any sequence(s) and/or temporal order of steps of various processes described and claimed herein are those considered to be the best mode contemplated for carrying out the present invention. It should also be understood that, although steps of various processes may be shown and described as being in a preferred sequence or temporal order, the steps of any such processes are not limited to being carried out in any particular sequence or order, absent a specific indication of such to achieve a particular intended result. In most cases, the steps of such processes may be carried out in various different sequences and orders, while still falling within the scope of the present inventions. In addition, some steps may be carried out simultaneously. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. An apparatus for creating expanded and non-expanded regions on a sheet of sheet metal comprising:

a programmable controller;

a feeder adapted to receive the sheet and responsive to said controller for incrementally advancing the sheet along a processing path;

a cutter/expander positioned along the processing path and adapted to receive the sheet from said feeder, said cutter/expander responsive to said controller for generating a row of expanded metal apertures between each incremental advance of the sheet, the apertures in alternating rows being laterally offset from each other;

each incremental advance of the sheet by said feeder having a first length when creating a respective expanded region of the sheet and a second length greater than the first length when creating a respective non-expanded region of the sheet.

2. The apparatus of claim 1 wherein said controller is a computer having computer-readable instructions installed therein.

3. The apparatus of claim 1 wherein said feeder comprises a pair of rollers and a feed motor for driving said rollers.

4. The apparatus of claim 3 wherein said feed motor is a servo motor.

5. The apparatus of claim 3 wherein said rollers advance the sheet by means of pressure applied to the sheet.

6. The apparatus of claim 3 wherein said rollers advance the sheet by means of frictional force applied to the sheet.

7. The apparatus of claim 1 wherein said cutter/expander comprises an upper and a lower die and wherein the sheet advances between said die.

8. The apparatus of claim 7 wherein said die are offset from each other in the direction of the processing path.

9. The apparatus of claim 7 wherein said upper die comprises a mounting arm and a plurality of pattern cutters.

10. The apparatus of claim 9 wherein said upper die is selectively movable perpendicular to the plane of the sheet between a disengaged and an engaged position, each respective row of apertures being generated by said pattern cutters when said upper die moves from the disengaged position to the engaged position.

11. The apparatus of claim 10 wherein said upper die is selectively moveable parallel to the plane of the sheet between a first cutting position and a second cutting position laterally offset from the first cutting position.

12. The apparatus of claim 11 wherein said cutter/expander further comprises a cam assembly and a cam motor for driving said cam assembly, said cam assembly controlling movement of said upper die between the first and second cutting positions, said upper die being in the first position when creating a first row of apertures and in the second position when creating a second row of apertures adjacent to the first row whereby the apertures in adjacent rows are laterally offset from each other.

13. The apparatus of claim 1 wherein each respective expanded metal region comprises a mesh pattern.

14. A method for creating expanded and non-expanded regions on a sheet of sheet metal comprising the steps of:

advancing the sheet a first predetermined distance along a processing path to define a first respective non-expanded metal region;

creating a respective expanded metal region comprising the steps of:

generating a first row of expanded metal apertures across the sheet;

advancing the sheet a second predetermined distance along the processing path; and generating a second row of expanded metal apertures across the sheet, the first and second row of apertures being laterally offset from each other; and advancing the sheet a third predetermined distance along the processing path to define a second respective non-expanded metal region.

15. The method of claim 14 wherein the second predetermined distance is shorter than the first and third predetermined distances.

16. The method of claim 14 wherein said steps of generating the rows of expanded metal apertures comprises simultaneously slitting and stretching selected locations across the sheet.

17. The method of claim 14 wherein the first predetermined distance is the same as the third predetermined distance.

18. The method of claim 14 wherein the first predetermined distance is different from the third predetermined distance.

19. The method of claim 14 wherein said step of creating the respective expanded metal region further comprises, after said step of generating the second row of expanded metal apertures, again advancing the sheet the second predetermined distance along the processing path and repeating a plurality of times said steps of generating the first row of expanded metal apertures, advancing the sheet the second predetermined distance, generating the second row of expanded metal apertures, and again advancing the sheet the second predetermined distance.

* * * * *